United States Patent [19]

Haffer

[11] Patent Number: 4,601,953

[45] Date of Patent: Jul. 22, 1986

[54] ROLLING SHUTTER BAR

[75] Inventor: Dieter Haffer, Pirmasens-Gersbach, Fed. Rep. of Germany

[73] Assignee: Gebruder Kommerling Kunststoffwerke GmbH, Pirmasens, Fed. Rep. of Germany

[21] Appl. No.: 706,559

[22] Filed: Feb. 27, 1985

[30] Foreign Application Priority Data

Mar. 1, 1984 [DE] Fed. Rep. of Germany ..... 3407640

[51] Int. Cl.[4] ..... E06B 9/10

[52] U.S. Cl. ..... 428/457; 160/232; 160/236; 160/133

[58] Field of Search ..... 160/133, 229 R, 232, 160/236, 104, 107, 235; 52/473; 428/35, 457

[56] References Cited

FOREIGN PATENT DOCUMENTS 2322254 3/1977 France ..... 160/236

2352148 12/1977 France ..... 160/236

*Primary Examiner*—John E. Kittle
*Assistant Examiner*—Thomas C. Saitta
*Attorney, Agent, or Firm*—Armstrong, Nikaido, Marmelstein & Kubovcik

[57] ABSTRACT

In a hollow plastic rolling shutter slat coated on the weather side with a metal layer for reducing the heat transfer while retaining the resistance to bending the inner side of the building-side profile wall is also coated with a metal layer, a minimum spacing always being provided between the two metal layers to insure the thermal insulation. The metal layers have at least one surface reflecting thermal radiation or reducing thermal irradiation. For obtaining the necessary resistance to bending the inner transverse webs of the hollow plastic rolling shutter bar are formed in such a manner that they transmit the shear stresses occurring on bending.

10 Claims, 4 Drawing Figures

ROLLING SHUTTER BAR

BACKGROUND OF THE INVENTION

1. Field of the Invention

The invention relates to a rolling shutter slat or bar.

2. Description of the Prior Art

Compared with rolling shutter bars of metal, platic bars are among other things cheaper, lighter and provide better thermal insulation but do have disadvantages. Thus, they are relatively less stiff under wind pressure and suction; furthermore, the coloring of the plastic must take account of the fact that it may under sunshine become hot to such an extent that the plastic is deformed.

These two disadvantages are remedied in a known rolling shutter bar (DE-AS No. 2,622,905) since the weather-side of the hollow profile is coated with a metal layer.

By suitable surface coating or treatment this metal layer may have a desired color but is nevertheless able to reflect sunlight to such an extent that there is no danger of any detrimental warming of the hollow profile section.

To improve the resistance to bending of the rolling shutter slat it was previously necessary to angle the metal layer towards the building side of the rolling shutter bar in order to form a relatively flexurally stiff metal profile which in turn reinforces the hollow profile.

However, any angled portion of the metal layer required for the necessary resistance to bending simultaneously forms a heat bridge which drastically increases the thermal conduction between the side facing the building and the outdoor side of the rolling shutter bar. This is contrary to one of the basic purposes of a rolling shutter, i.e. providing an effective thermal insulation in heating periods to reduce heat losses through the window.

SUMMARY OF THE INVENTION

Therefore, the invention has as its object to provide a rolling shutter bar or slat wherein the afore said disadvantages to not occur.

More particularly the invention is based on the problem of improving the known rolling shutter slat in such a manner that at least whilst retaining its resistance to bending the thermal conduction between the inner side and outer side is greatly reduced. Thus, a roller bar is desired which has at least the resistance to bending of the roller bar according to DE-AS No. 2 622 905 but simultaneously has a thermal-insulating effect which approaches that of a rolling shutter bar formed only from a plastic hollow profile bar.

Accordingly the invention provides a rolling shutter bar or slat comprising a plastic hollow profile bar and a weather-side metal layer which is connected in material-locking or adhesive manner to the plastic hollow profile bar, the weather-side and the building side plastic hollow profile walls being connected together by webs, in which on the inside of the building-side wall of the hollow profile a further metal layer connected in material-locking manner to said wall is provided, in which the webs and their transitions into the metal-reinforced wall portions of the hollow profile have dimensions adequate enough to transmit the longitudinal shear stresses occurring on full utilization of the metal reinforcement for the stiffening, and that the metal reinforcements in each case have at least one surface reflecting thermal radiaton and reducing thermal irradiation.

To insure the necessary bending resistance not only the weather-side hollow profile wall but also the building-side hollow profile wall is stiffened with a metal layer and the webs connecting these two walls are formed so that they can transmit longitudinal shear stresses. Thus, the entire rolling shutter bar is formed as a hollow section whose top and bottom chords are formed by a metal layer of high tensile strength which is substantially higher than that of the plastic of the hollow profile section. The plastic of the webs is however able to take up the shear stresses occurring when the shutter bar is subjected to a load, and the webs may if necessary be thickened without requiring much additional material because they are relatively short.

A further feature of the rolling shutter slat according to the invention is that the additional metal layer is not as might actually have been obvious applied on the outside of the building-side profile wall but on the inside thereof This step insures that when the shutter is wound up a metal layer does not come to lie on another metal layer, thus greatly reducing the danger of scratching of the weather-side metal surface. This metal surface is thus able to retain permanently its heat-reflecting action and its action preventing thermal irradiation.

Additionally, the additional metal layer lying in the interior of the profile comprises at least one surface which is formed for reflection of the thermal radiation or preventing thermal irradiation. Since none of the surfaces of the additional metal layer is accessible each of said surfaces can retain its condition over the full utilization period of the rolling shutter bar. Thus, the metal surface directed towards the inside of the building and adhering to the profile wall acts to a certain extent reflective with respect to thermal radiation from the building whilst the other surface, if for example bright-rolled, reduces the emission of thermal radiation.

Thus, in particular the additional metal layer acts as thermal radiation barrier and thus retains not only the insulating effect of the plastic hollow profile bar but even improves it.

Due to the shear-transmitting configuration of the plastic webs no metal portion extending between the inside and outside as in the known shutter bar is necessary and consequently the two metal layers extend substantially only in regions in which substantially the same temperature obtains so that the two metal layers cannot themselves transfer any heat.

According to a preferred development of the invention the two metal layers have additionally all over a minimum distance from each other which is equal substantially to the smallest thickness of the shutter bar. Thus, although it is then possible for instance for reinforcing the engagement strip of the shutter bar also to use the weather-side metal layer as long as the latter always has the aforementioned minimum distance from the building-side metal layer of the same or adjacent roller bar the insulating effect of the roller bar according to the invention is always substantially maintained.

The two metal layers, preferably coated with adhesive on the side facing the plastic, are preferably extrusion-laminated with the hollow profile, the two possibly preformed metal strips being introduced into an extrusion nozzle. It must be insured that in the region of the additional metal layer the shear-transmitting connection between the latter and the webs is established.

For this purpose, according to a further development of the invention it is proposed that this additional metal layer is formed by a sheet metal strip which in the region of the connection of the webs to the building-side profile wall is perforated. The webs thus enter direct material joining to the building-side profile wall, engaging in bridge-like manner onto the sheet metal portions remaining between the perforation of the metal strip.

The shear-transmitting connection between metal strip and webs is by the material-locking connection between metal strip and profile wall and by direct material connection between profile wall and web. To improve the latter material joint according to a further development of the invention the perforation in the metal strip is formed by a row of closely adjacent slots. The sheet metal portions between two consecutive slots may be made so narrow that all that is insured is the proper introduction of the perforated strip into the extrusion mold.

According to a further development of the invention it is however also possible to use an unperforated metal strip which, coated on both sides with a bonding agent, is introduced into the extrusion mold and bonded on the one side to the building-side profile wall and on the other to the webs, in each case by a material-locking connection in shear-transmitting manner. For this purpose, advantageously the portion of the web adjacent the said metal layer can be formed to a wide base whose material-locking connection to the metal layer then guarantees the proper transmission of shear stresses.

According to a further development of the invention however instead of a metal strip continuous over the profile height a number of narrower individual metal strips may be formed which each adhered to the profile wall surface between two adjacent webs. By the material-locking connection with the building-side profile wall these adjacent narrow strips have an overall effect like that of a continuous metal strip. Since however the areas between the adjacent metal sub-strips in which the webs are connected to the building-side profile wall are left out, this connection essential to the bending resistance of the shutter bar according to the invention can take place without disturbance.

For proper introduction of the metal sub-strips into an extrusion mold the metal sub-strip preferably comprises at least one guide rabbet by means of which it can be introduced precisely into the extrusion mold so that any interference with the essential connecting region between webs and profile wall is eliminated. Such a rabbet additionally acts as stiffening of the respective metal sub-strip but because of its small height practically does not impair the thermal-insulating effect of the rolling shutter bar according to the invention.

According to a further development of the invention the metal layers are made from thin aluminium sheet whose thickness is preferably about 0.2 mm. A sheet of such low thickness due to the arrangement of the shutter bar according to the invention is adequate to impart to the latter several times the resistance to bending of an uncoated plastic hollow profile bar. Simultaneously, the use of a thin aluminium sheet has the advantage that in the extrusion operation said sheet is pressed into area contact with the respective wall of the extrusion nozzle so that the dimensional accuracy of the shutter bar is insured. Any pattern formed on a visible face of such a metal surface withstands the extrusion operation. The shaping of the metal layer may take place during the extrusion operation, the respective metal layer being preformed by a correspondingly formed entry and the finished shaping then conducted during the extrusion operation in the manner described above.

According to a further development of the invention the outside of the weather-side metal layer is provided with a coating or a surface treatment layer which promotes or retains the effects of said surface of reflecting thermal radiation or reducing thermal irradiation. In the case of aluminium sheet for example an oxidation treatment is suitable which serves not only for coloring but also insures a very thin but very hard oxide layer which maintains the smooth-rolled condition of the surface treated for a long period of use.

According to a further development of the invention the ends of the rolling shutter bar are closed, in particular by means of foaming with hard foam. This end closure not only prevents heat losses by heated air flowing out of the interior of the shutter bar but simultaneously provides an end stiffening of the shutter bars in those regions in which said bar is guided and in which therefore on bending the forces opposing said bending are introduced into the rolling shutter bar. In addition, as a result deposits on the metal surface inside the cavity due to dirt particles which would impair the radiation properties are largely prevented.

DESCRIPTION OF THE DRAWINGS

The subject of the invention will be explained in detail with the aid of the attached schematic drawings, wherein.

DESCRIPTION OF PREFERRED EMBODIMENTS

Figure 1:
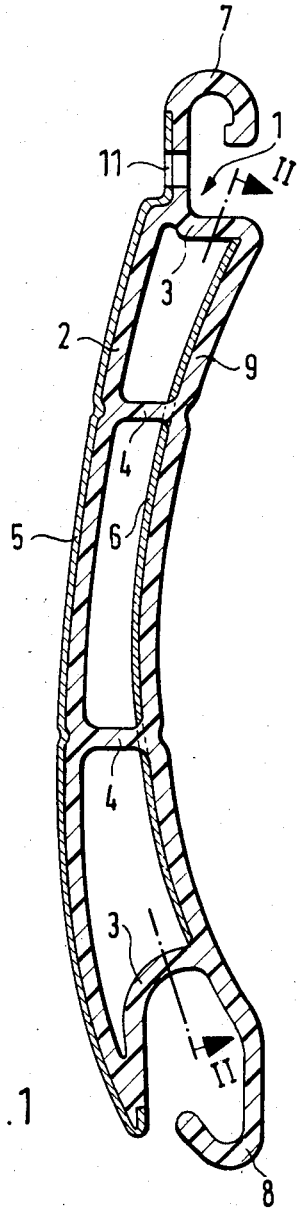
FIG. 1 is a rolling shutter slat according to the invention in cross-section to a scale of about 1:4.

Similar or identical elements are designated in all the Figures with the same reference numerals.

FIG. 1 shows a rolling shutter bar according to the invention in cross-section. This shutter slat is formed by a plastic hollow profile bar 1 which has two slightly curved substantially parallel outer walls, the weather-side wall 2 and a building-side wall 9 which to form a closed box section are joined together at their ends in each case by an outer web 3.

The interior is divided into three overlapping inner cavities extending in the longitudinal direction of the plastic hollow profile bar 1, of which the center cavity is separated from the two outer cavities in each case by an intermediate web 4 whilst the two outer cavities are separated from the outside in each case by one of said outer webs 3.

At the top side (shown in the drawings) on the box section described a suspension strip 7 is formed which is hook-shaped in cross-section and which in the region of its connection to the closed box section has light and ventilation holes 11.

At the bottom side of said box profile a connection strip 8 is formed which is likewise of hook-shaped cross-section and is made complementary to the suspension strip 7 in such a manner that two consecutive plastic hollow profile bars can be inserted into each other with their strips 7, 8, producing an articulate connection between said two plastic hollow profile bars.

The outside of the weather-side wall 2 is covered in material-locking manner, i.e. firmly bonded, with a metal weather layer 5 comprising a aluminium sheet of for example 0.3 mm which extends towards the grip strip beyond the weather-side wall 2 and is turned in a small distance towards the adjacent outer web 3.

At the upper (in the drawing) end the weather layer 5 extends beyond the light and ventilation holes 11 and terminates in the region of the suspension strip 7 at the weather side thereof.

Figure 2:
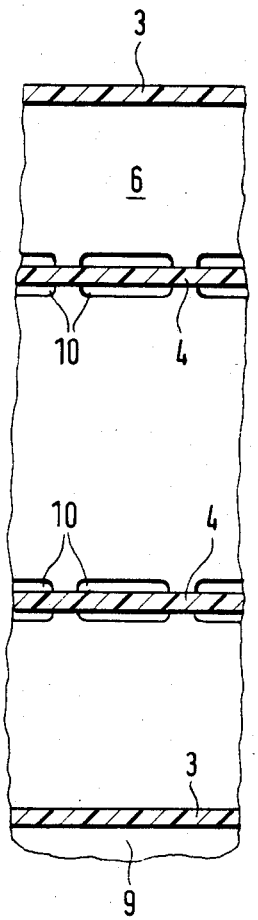
FIG. 2 is a section along the line II—II of FIG. 1, and FIG. 3 and FIG. 4 are each a partial section similar to FIG. 1 of respective further embodiments of the invention.

On the inside, i.e. the side of the building-side wall 9 facing the weather wall 2, an inner layer 6 of aluminium sheet of for example 0.3 mm thickness is applied. As apparent from FIGS. 1 and 2 the metal inner layer 6 comprises in the region of the intermediate webs 4 two rows of slots 10 which extend in the longitudinal direction of the shutter bar and are adjacent each other some distance apart. Said slots are traversed by the base of the adjacent intermediate webs 4, the latter entering a shear-transmitting and shear-resistant connection with the building-side wall 9.

Figure 3:
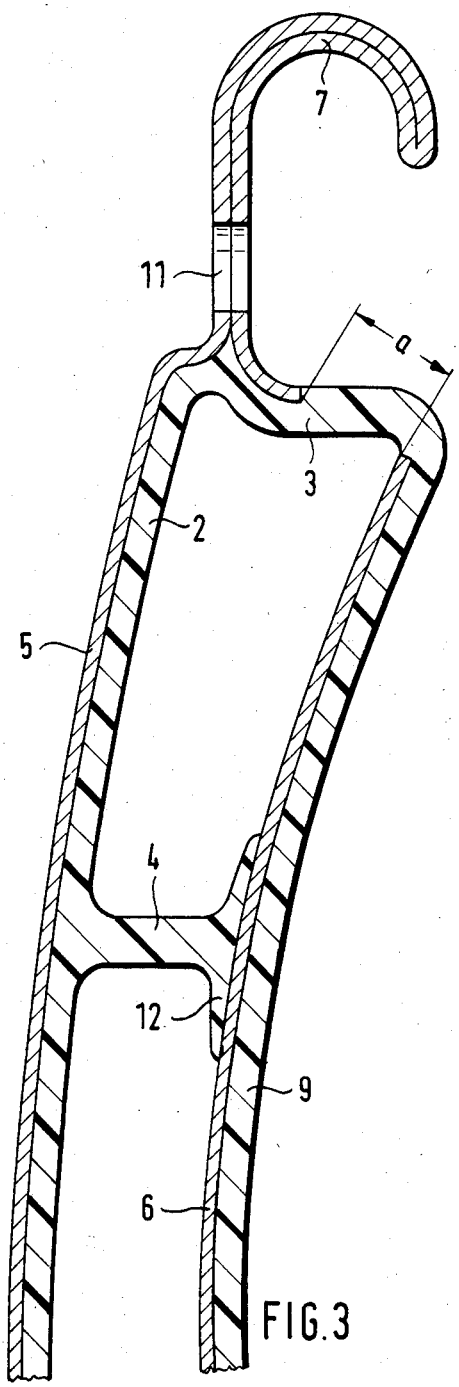

In FIG. 3 the shear-resistant connection between the building-side wall 9 and the intermediate webs 4 is established via the agency of the inner layer 6: Said inner layer 6 is disposed as in the subject of FIG. 1 in material-locking connection with the inner side of the housing-side wall 9 but does not have any slots. Instead, the adjoining region of the respective intermediate web 4 is formed as base 12 which in turn is in material-locking, i.e. adhesive, connection with the adjacent inner layer 6. The engaging surface of the base 12 is selected so that the desired shear strength is insured.

At the same time the suspension strip 7 is not formed as part of the plastic hollow profile bar 1 but as part of the weather layer 5 which for this purpose is formed to a hook-like rabbet.

Essential is that the spacing a apparent in FIG. 3 is dimensioned large enough to prevent formation of a heat bridge at this point.

Figure 4:
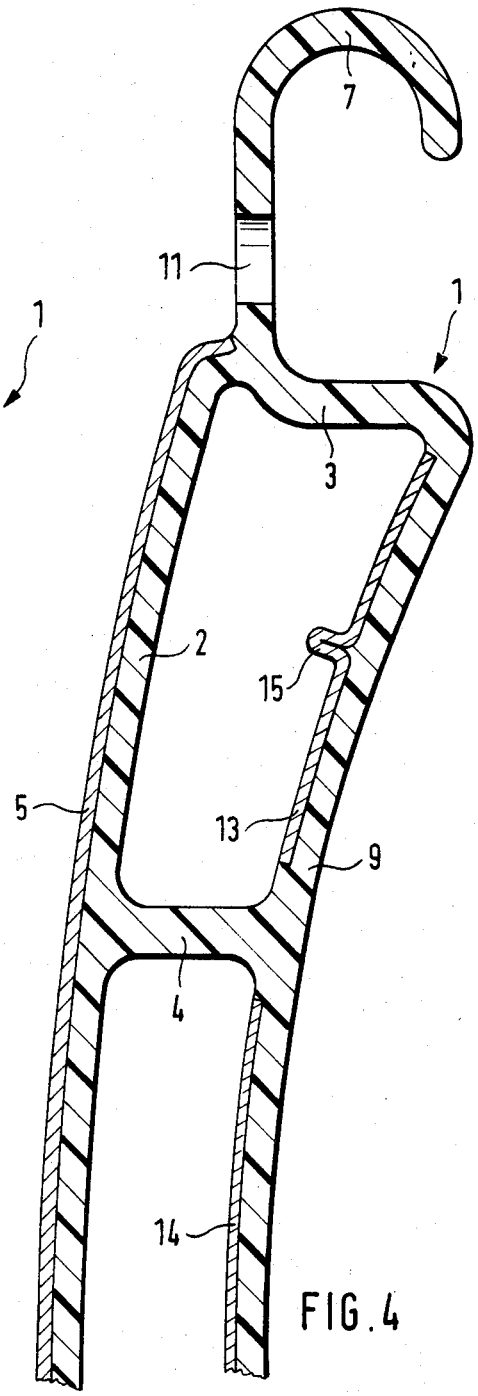

FIG. 4 shows a further embodiment of the rolling shutter bar. In this case the weather layer 5 does not extend as in the subject of FIGS. 1 and 3 beyond the light and ventilation holes 11 but only up to just before them. The suspension strip 7 is formed as unreinforced extension of the plastic hollow profile bar 1.

Instead of a continuous inner layer 6 sheet metal sub-strips 13, 14 are provided which extend only up to the region of the transition between the respective intermediate web 4 and the building-side wall 9 so as not to impair said shear-transmitting transition. In this case the upper sub-strip 13 in the drawing comprises in the region of its center a rabbet 15 which serves to guide the sub-strip 13 on introduction thereof into an extrusion mold and at the same time to stiffen it. The sub-strip 14 also shown in FIG. 4 does not however have such a rabbet.

What is claimed is:

1. A rolling shutter bar comprising a hollow plastic member having a weather-side wall and a building side wall, said walls being spaced from each other to form a hollow therebetween by plastic web members molded thereon and extending therebetween, a first metal layer covering the outer exposed surface of said weather-side wall and adhered to the surface thereof, a second metal layer covering the surface of said building side wall in said hollow between said walls and adhered to the hollow wall surface of said building side wall, said metal layer coverings reinforcing said walls, said webs between said walls having a thickness adequate to transmit longitudinal shear stresses applied to said reinforced walls, at least one of said metal layer coverings having a surface for reflecting thermal radiation and reducing thermal irradiation.

2. Rolling shutter bar according to claim 1, in which the two metal layers have everywhere a minimum spacing from each other which is substantially equal to the smallest thickness of the rolling shutter bar.

3. A rolling shutter bar according to claim 1, in which said second metal layer is formed from a metal strip perforated at the connections of said webs to said building side wall.

4. A rolling shutter bar according to claim 3 in which said perforations are formed by closely adjacent slots.

5. A rolling shutter bar according to claim 1, in which said second metal layer is adhered to said hollow wall surface of said building side wall and said webs for transmitting sheer stresses therebetween.

6. A rolling shutter bar according to claim 1 in which said second metal layer is formed by at least two sheet metal sub-strips which are arranged between the transitions of the webs and building-side profile wall at the inner side thereof.

7. A rolling shutter bar according to claim 6, in which the sheet metal sub-strips have at least one guide rabbet.

8. A rolling shutter bar according to claim 1, in which the metal layers are formed from thin aluminum sheet having a preferred thickness of about 0.2 mm.

9. A rolling shutter bar according to claim 1, in which said first metal layer covering the outside of the weather-side wall is provided with a treatment which promotes the effect of said surface of reflecting thermal radiation and reducing thermal irradiation.

10. A rolling shutter bar according to claim 1, in which the ends of the rolling shutter bar are sealed with foam.

* * * * *